US011602833B2

(12) United States Patent
Dance et al.

(10) Patent No.: US 11,602,833 B2
(45) Date of Patent: Mar. 14, 2023

(54) DIRECTION SELECTOR MECHANISM FOR A POWER TOOL

(71) Applicant: Snap-on Incorporated, Kenosha, WI (US)

(72) Inventors: William Berry Dance, Murphy, NC (US); Matthew D. Patterson, Knoxville, TN (US)

(73) Assignee: Snap-on Incorporated, Kenosha, WI (US)

( * ) Notice: Subject to any disclaimer, the term of this patent is extended or adjusted under 35 U.S.C. 154(b) by 88 days.

(21) Appl. No.: 16/890,348

(22) Filed: Jun. 2, 2020

(65) Prior Publication Data

US 2021/0370489 A1 Dec. 2, 2021

(51) Int. Cl.
*B25F 5/02* (2006.01)
*B25F 5/00* (2006.01)

(52) U.S. Cl.
CPC ..... *B25F 5/02* (2013.01); *B25F 5/001* (2013.01)

(58) Field of Classification Search
CPC ..... B25F 5/02; B25F 5/001
See application file for complete search history.

(56) References Cited

U.S. PATENT DOCUMENTS

| | | | | |
|---|---|---|---|---|
| 3,742,364 | A | 6/1973 | Matthews | |
| 8,418,779 | B2 | 4/2013 | Leong et al. | |
| 9,687,977 | B2 | 6/2017 | Papp | |
| 2006/0028089 | A1 | 2/2006 | Buck et al. | |
| 2015/0122524 | A1* | 5/2015 | Papp | B25B 21/00 173/20 |
| 2018/0361557 | A1 | 12/2018 | Bantle et al. | |
| 2018/0361558 | A1 | 12/2018 | Bantle et al. | |
| 2018/0361559 | A1 | 12/2018 | Bantle et al. | |
| 2018/0370011 | A1* | 12/2018 | Bantle | B25F 5/001 |

FOREIGN PATENT DOCUMENTS

| | | |
|---|---|---|
| EP | 0790697 | 4/2004 |
| EP | 1426989 A1 | 6/2004 |
| EP | 3389947 | 4/2020 |
| EP | 3389942 | 7/2020 |
| WO | 2017102513 | 6/2017 |
| WO | 2017102515 | 6/2017 |

OTHER PUBLICATIONS

Combined Search and Examination Report for corresponding Application No. GB2107097.4 dated Oct. 15, 2021, 8 pages.
Examination Report No. 1 for corresponding Application No. 2021203574 dated Mar. 9, 2022, 5 pages.

* cited by examiner

*Primary Examiner* — Daniel Jeremy Leeds
(74) *Attorney, Agent, or Firm* — Seyfarth Shaw LLP

(57) ABSTRACT

A direction selector mechanism for a hand-held power tool that includes internal linkages that move an actuation point of a direction selection from above the trigger (as in previous tools) to a top of the tool. For example, the control for the direction selector mechanism includes a direction toggle positioned on a top of the tool, and that is movable by a user to select either of first and second rotational directions (e.g. clockwise and counter-clockwise). This position/location allows the user to select or change between the first and second rotational directions with a user's thumb for both direction changes, in either hand ambidextrously, and places the trigger actuation higher up in the tool, closer to the axis of output of the tool.

19 Claims, 9 Drawing Sheets

DIRECTION SELECTOR MECHANISM FOR A POWER TOOL

TECHNICAL FIELD OF THE INVENTION

The present invention relates to a direction selector that selectively changes a rotational direction of a power tool.

BACKGROUND OF THE INVENTION

Many tools are powered by electric power, via an external power source (such as a wall outlet) or a battery. Drills, for example, impart torque to a work piece to loosen or tighten the work piece. At times, the rotational direction of the tool must be reversed, for example, when the work piece is left-hand threaded or when a user desires to loosen a right-hand threaded work piece instead of tighten it with the tool.

Existing tools include direction selection mechanisms that selectively control the rotational direction of the tool. These direction selection mechanisms controls are typically located next to and above a trigger of the tool. These mechanisms also typically include depressible buttons located on opposing sides of the tool that the user can use to select the desired rotational direction of the tool.

SUMMARY OF THE INVENTION

The present invention relates broadly to a rotational direction selector mechanism for a power tool, such as a drill, router, grinder, impact wrench, ratchet wrench, screwdriver, or other powered tool, that is powered by electricity via an external power source (such as a wall outlet and/or generator outlet) or a battery. The direction selector mechanism includes internal linkages that move an actuation point of a direction selection from above the trigger (as in previous tools) to a location convenient to a user for operation of the tool, such as a top of the tool. For example, the control for the direction selector mechanism includes a direction toggle positioned on a top of the tool, and that is movable by a user to select either of first and second rotational directions (e.g. clockwise and counter-clockwise). This position/location of the selector allows the user to select or change between first and second rotational directions with a user's thumb for both direction changes, in either hand ambidextrously, and places the trigger actuation higher on the tool, closer to the axis of output of the tool. This provides ergonomic advantage during operation.

In particular, the present invention broadly comprises a direction selector mechanism for a motor of a tool. The direction selector mechanism includes a direction selector disposed proximal to a rear end of the tool and actuatable by a user. A gear mechanism includes first gear teeth, and is disposed in a housing of the tool and coupled to the direction selector, wherein actuation of the direction selector causes the gear mechanism to rotate. A switch linkage arm is disposed in the housing and includes second gear teeth meshingly engaged with the first gear teeth, and the switch linkage arm is adapted to engage a switch of a switch mechanism disposed in the tool. Rotation of the gear mechanism causes movement of the switch link arm, which causes movement of the switch to select either of the first and second rotational directions of the motor.

In another embodiment, the present invention broadly comprises a tool including a housing, a motor disposed in the housing and adapted to selectively rotate a motor shaft in either of first and second rotational directions, and a switch mechanism disposed in the housing and operably coupled to the motor. A direction selector is disposed proximal to a rear end of the tool. A gear mechanism including first gear teeth is disposed in the housing and coupled to the direction selector. Movement of the direction selector causes the gear mechanism to rotate. A switch linkage arm is disposed in the housing and includes second gear teeth engaged with the first gear teeth, and the switch linkage arm is engaged with a switch of the switch mechanism.

Rotation of the gear mechanism causes movement of the switch link arm, which causes movement of the switch to select either of the first and second rotational directions.

BRIEF DESCRIPTION OF THE DRAWINGS

For the purpose of facilitating an understanding of the subject matter sought to be protected, there is illustrated in the accompanying drawing embodiments thereof, from an inspection of which, when considered in connection with the following description, the subject matter sought to be protected, its construction and operation, and many of its advantages, should be readily understood and appreciated.

DETAILED DESCRIPTION

Figure 1:
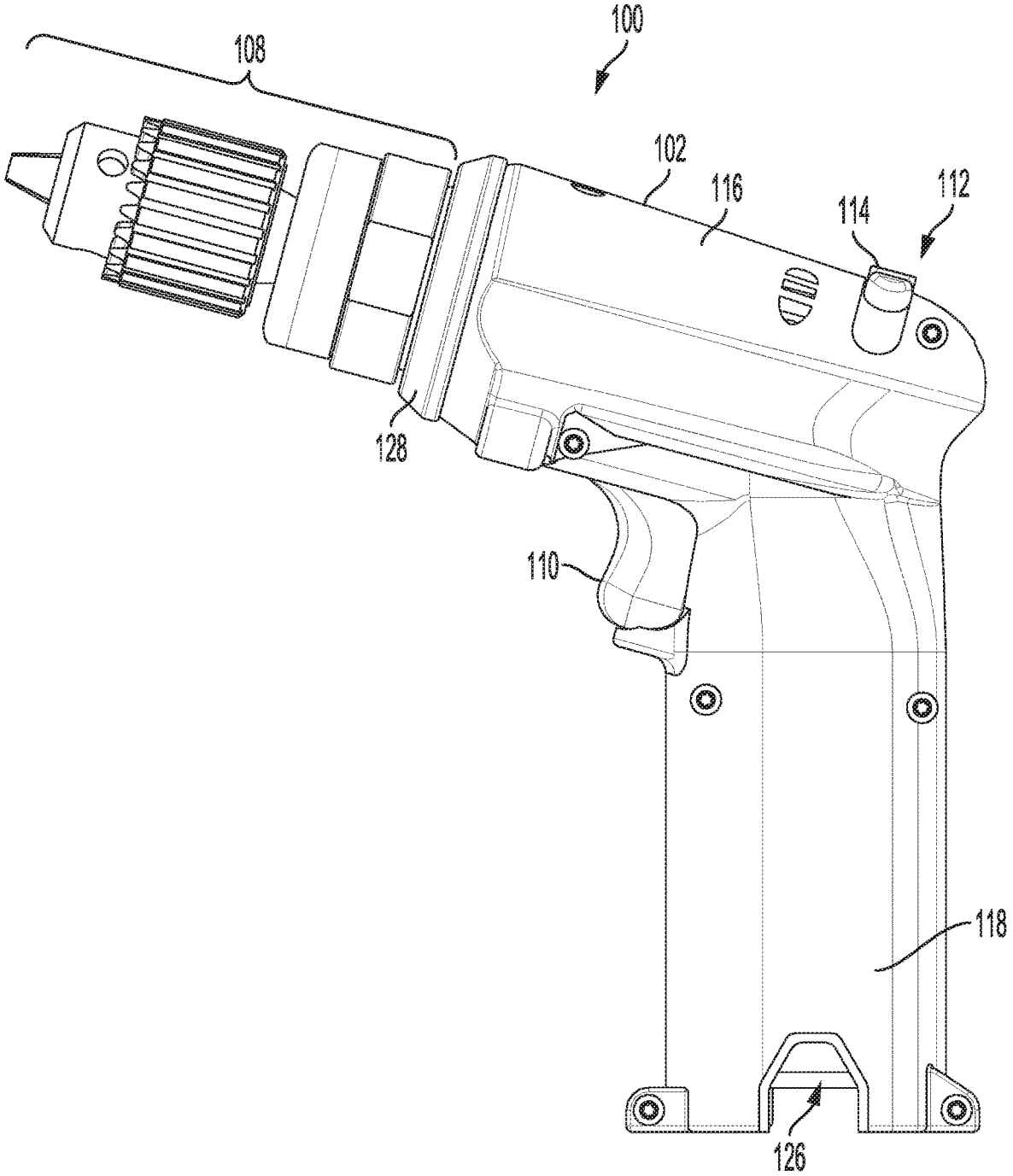
FIG. 1 is a side view of a tool according to an embodiment of the present invention.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention relates broadly to a direction selector mechanism for a power tool, such as a drill, router, grinder, impact wrench, ratchet wrench, screwdriver, or other powered tool, that is powered by electricity via an external power source (such as a wall outlet and/or generator outlet) or a battery and includes a motor and motor shaft. The direction selector mechanism includes internal linkages that move an actuation point of a direction selection from above the trigger (as in previous tools) to allocation convenient for a user to operate the tool, such as a top of the tool, preferably towards the rear. For example, the control for the direction selector mechanism includes a direction toggle positioned on a top of the tool, and that is movable by a user to select either of first and second rotational directions of the tool (e.g. clockwise and counter-clockwise). This position/location allows the user to select or change between the first and second rotational directions with a user's thumb for both direction changes, in either hand ambidextrously, and also places the trigger actuation higher on the tool, closer to the axis of output of the tool. This provides ergonomic advantage during operation.

Figure 2:
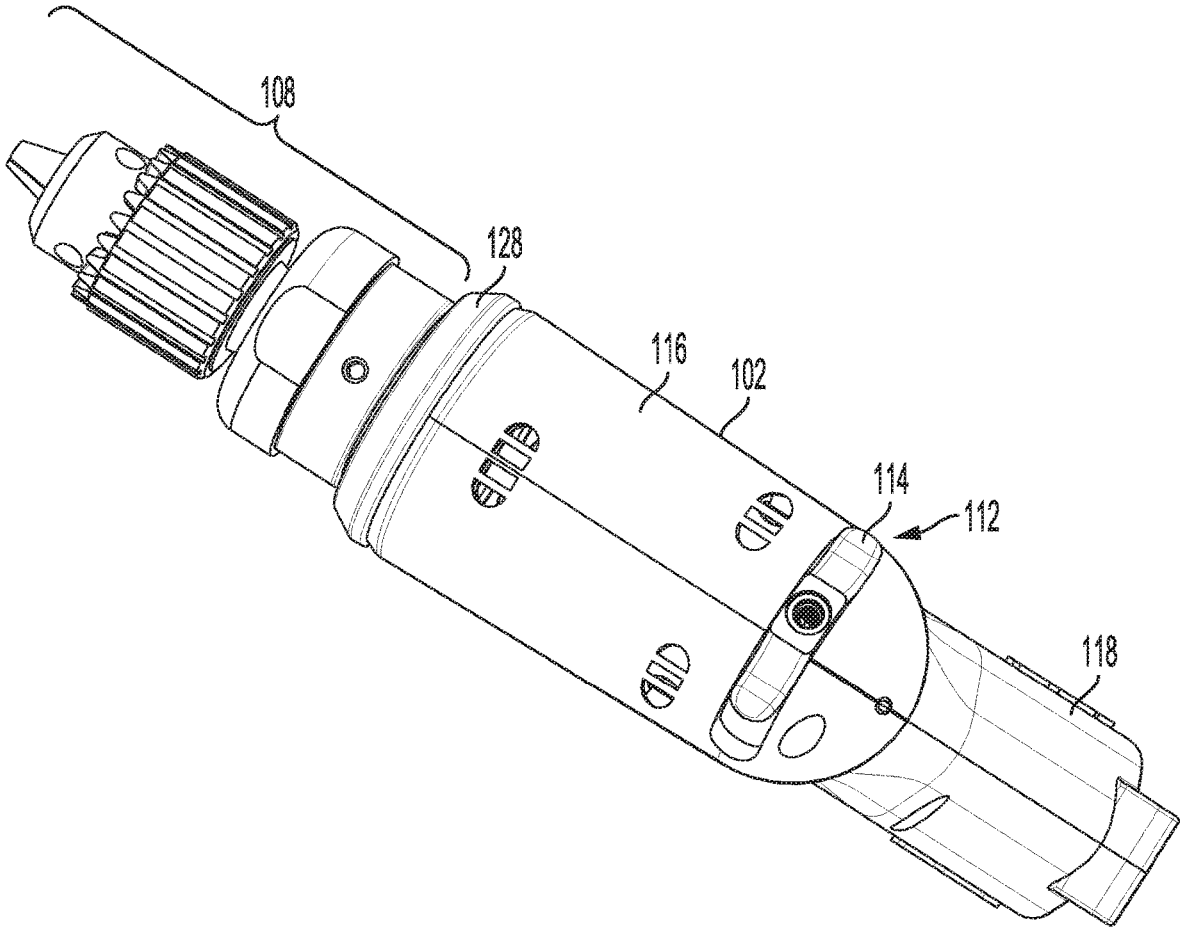
FIG. 2 is a top view of the tool of FIG. 1.
Figure 3:
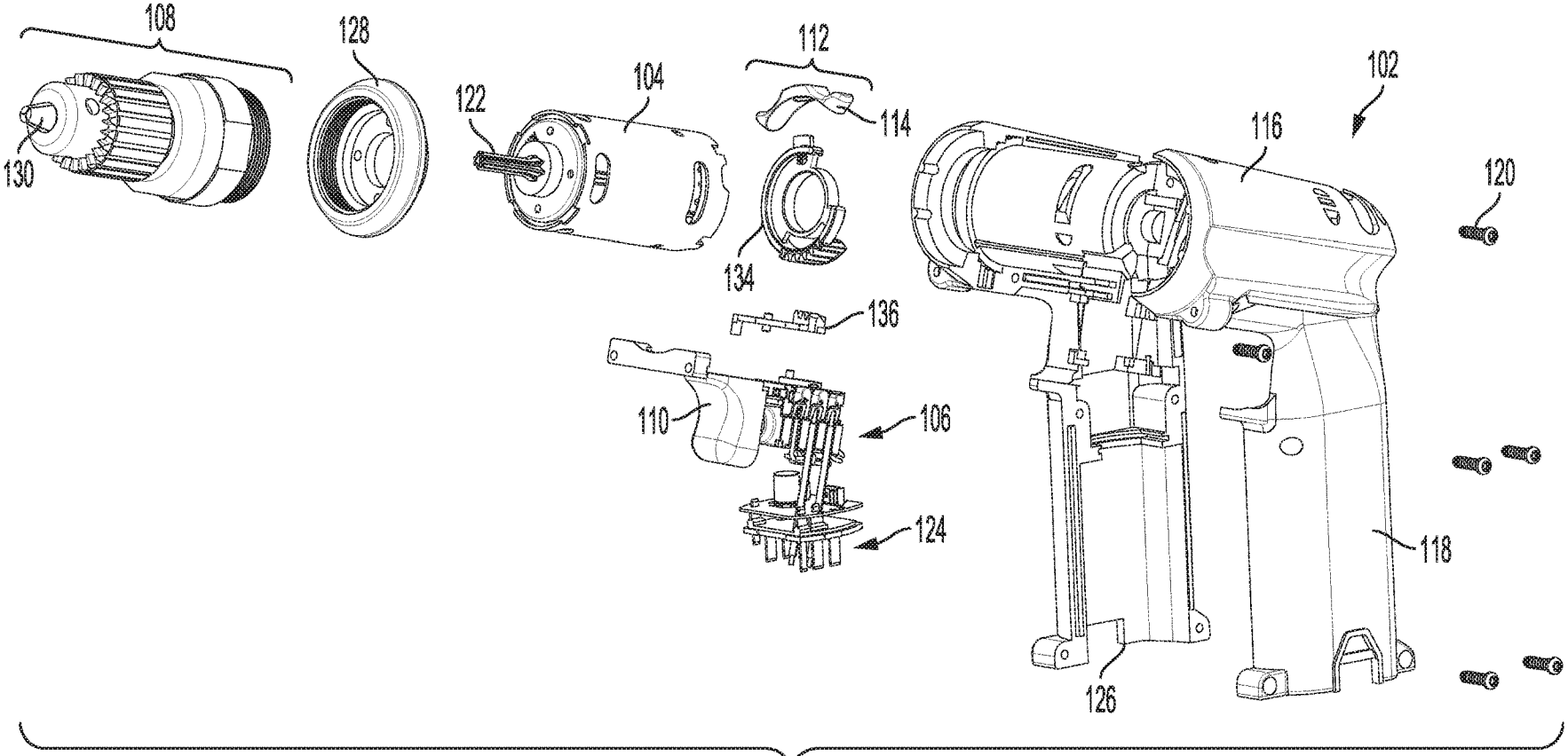
FIG. 3 is a perspective exploded view of the tool of FIG. 1.
Figure 4:
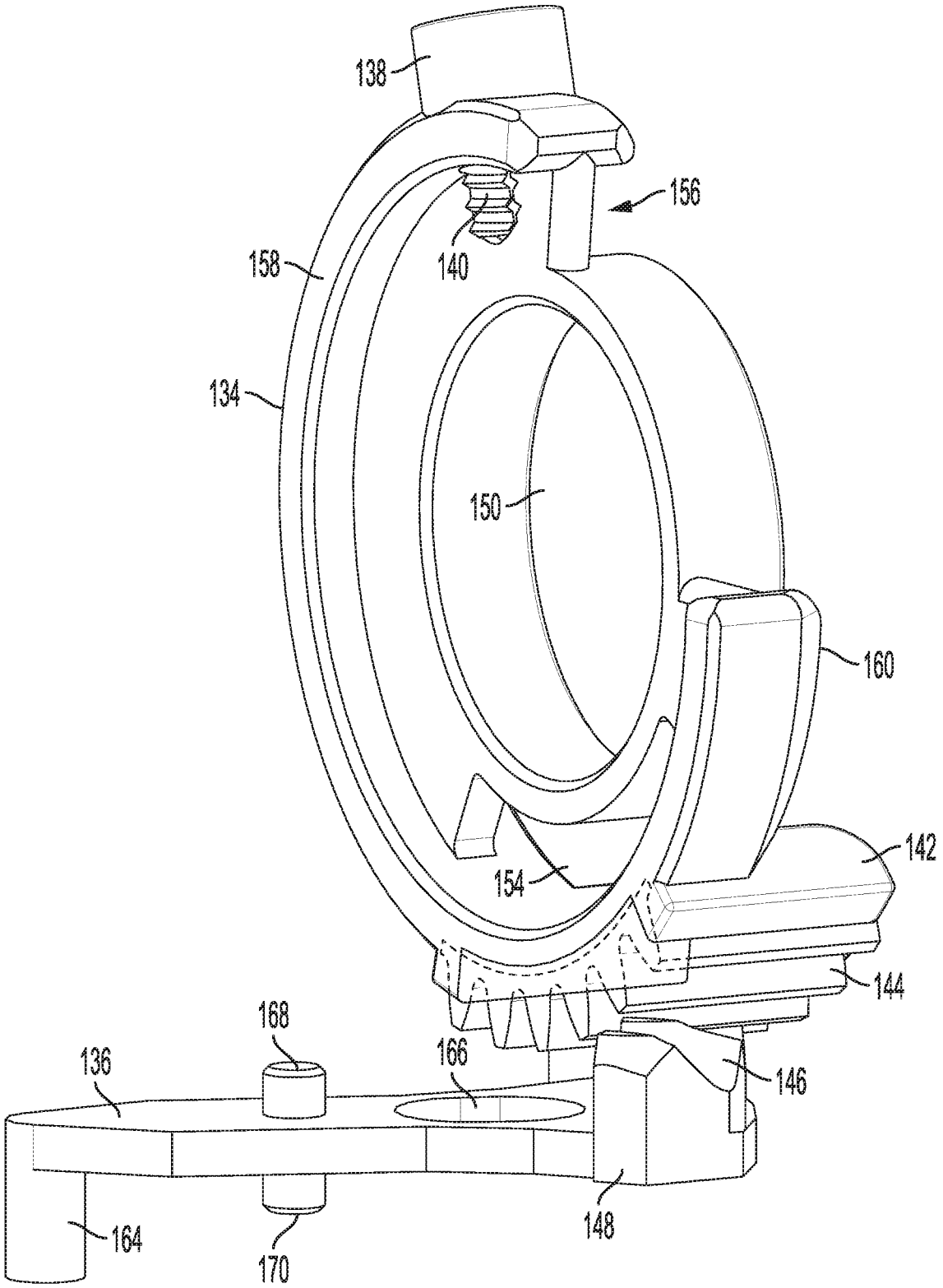
FIG. 4 is a first perspective view of linkages of a direction selector according to an embodiment of the present invention.
Figure 5:
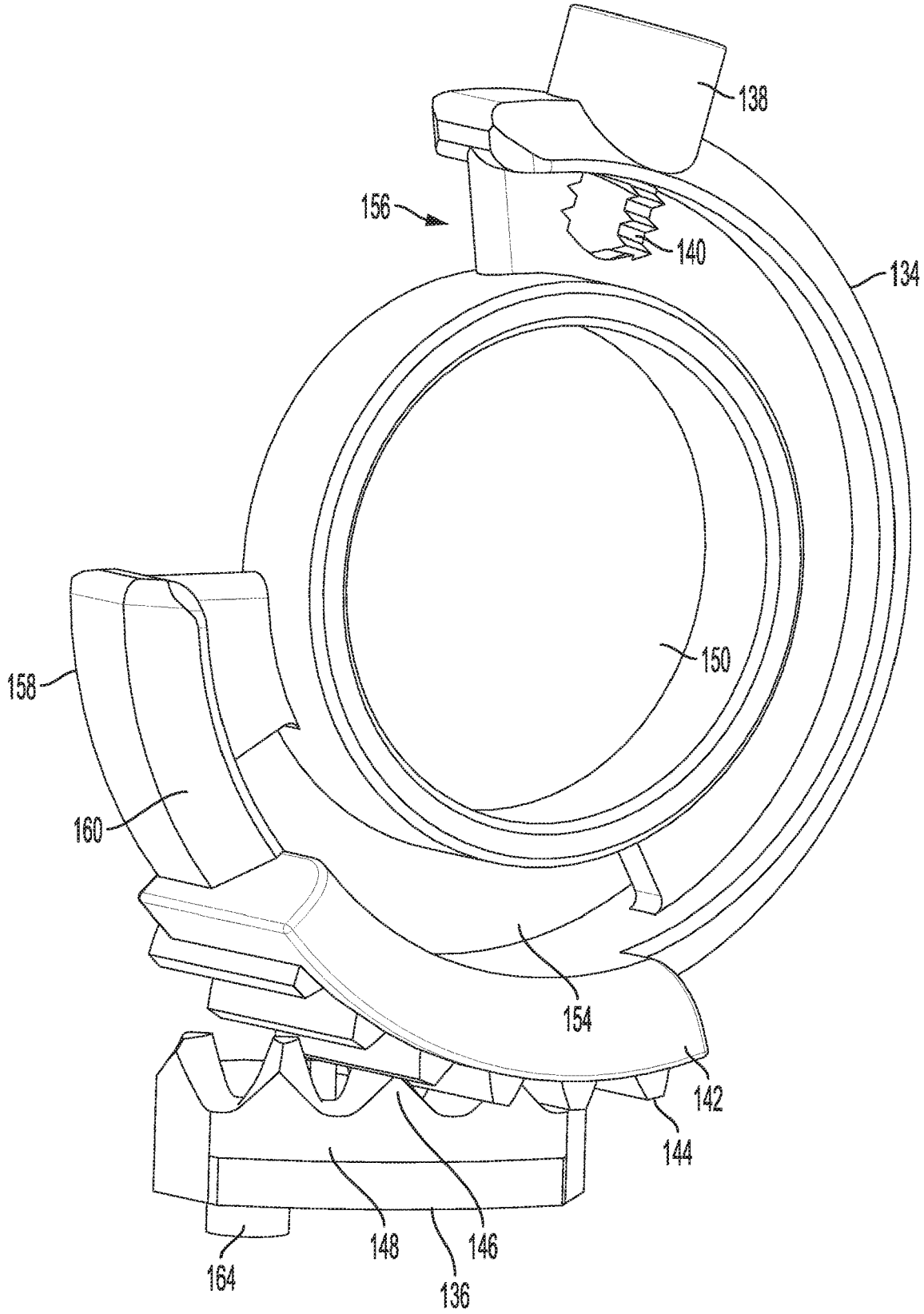
FIG. 5 is a second perspective view of the linkages of the direction selector mechanism of FIG. 4.

Referring to FIGS. 1-3, in an embodiment, the present invention includes a tool 100 having a housing 102, a motor 104 and a switch mechanism 106 disposed in the housing 102, an output nose mechanism 108 coupled to the housing 102 at a working end of the tool 100, an actuatable trigger 110, and a direction selector mechanism 112 with a direction selector (also referred to as an actuator or toggle) 114. The direction selector mechanism 112 includes internal mechanisms (described below) that allow the direction selector 114 to be disposed on a top portion of the housing 102, preferably near a rear end of the tool 100. In other embodiments, the direction selector mechanism can position the direction selector at any convenient location on the tool.

The housing 102 includes a motor housing portion 116 and a handle housing portion 118. In an embodiment, the motor housing portion 116 and handle housing portion 118 are disposed at an angle with respect to each other. For example, a longitudinal axis of the motor housing portion 116 and a longitudinal axis of the handle housing portion 118 are disposed at an angle of about 100 to about 120 degrees, and more particularly about 110 degrees with respect to each other. The housing 102 may also be a clamshell type housing with first and second housing halves that are coupled together via one or more fasteners 120.

The motor 104 is disposed in the motor housing portion 116, and includes a motor output shaft 122 extending from a working end of the motor 104. The switch mechanism 106 is disposed in the handle housing portion 118, and is operably coupled to the motor 104. The actuatable trigger 110 is disposed substantially at an intersection of the handle and motor housing portions 116 and 118, and is operably coupled to the switch mechanism 106. Actuation of the trigger 110 (such as depression of the trigger 110) causes the motor 104 to operate, thus causing the motor shaft 122 to rotate in either one of first and second rotational directions. The trigger 110 may also be biased such that the trigger 110 is depressible inwardly, relative to the tool 100, to cause the tool 100 to operate, and a release of the trigger 110 causes the trigger 110 to move outwardly, relative to the tool 100, to cease operation of the tool 100 via the biased nature of the trigger 110.

The motor 104 may be a brushless or brushed type motor, or any other suitable motor. The trigger 110 and switch mechanism 106 may also be a variable speed type mechanism. In this regard, actuation or depression of the trigger 110 causes the motor 104 to rotate the motor shaft 122 at a faster speed the further the trigger 110 is depressed. For example, a small or slight depression of the trigger 110 causes the motor 104 to rotate the motor shaft 122 at a first speed (e.g. a slow speed), full depression of the trigger 110 causes the motor 104 to rotate the motor shaft 122 at a second speed (e.g. a fast speed), and a medium depression of the trigger 110 causes the motor 104 to rotate the motor shaft 122 at a third speed (e.g. a speed faster than the first speed and slower than the second speed).

The switch mechanism 106 may also be coupled to a controller 124 (which may include a printed circuit board) including battery contacts that couple to corresponding electrical contacts on a removable battery. In this regard, the handle housing portion 118 may include a battery opening 126 adapted to receive and coupled to the removable battery. While, the tool 100 is described as being powered by a battery, the tool 100 may be power by other electrical power sources, such as an external wall outlet, etc., or other power sources, such as a fuel cell.

The output nose mechanism 108 is adapted to couple to the working end of the housing 102 of the tool 100, and may include a chuck 130 adapted to receive a variety of tool bits (including, driver bits, drill bits, cutting bits, socket bits, grinding bits, etc.). In some embodiments, the tool 100 may include an adaptor 128 adapted to couple to the first and second housing halves at the working end of the housing 102. The output nose mechanism 108 may couple to the adaptor 128, and receive and engage the shaft 122 of the motor 104. For example, the output nose mechanism 108 may include a gear or transmission mechanism 132 (illustrated in FIG. 8) that couples to the shaft 122 of the motor 104, and transfers rotation of the shaft 122 to the chuck 130. Thus, rotation of the shaft 122 of the motor 104 causes rotation of the chuck 130.

Referring to FIGS. 3-8 the direction selector mechanism 112 includes the direction selector 114, a gear mechanism 134, and a switch linkage arm 136. The gear mechanism 134 is adapted to be disposed in the motor housing portion 116 proximal to a rear of the motor 104. The gear mechanism 134 has a substantially circular shape, but may have other geometric shapes. As illustrated in FIGS. 4-7, the gear mechanism 134 includes a toggle connection portion 138 near a top of the gear mechanism 134. The connection portion 138 may be internally threaded with internal threads 140 adapted to receive a fastener to couple the selector mechanism 112 to the gear mechanism 134 at the connection portion 138.

The gear mechanism 134 also includes a first gear portion 142 with first gear teeth 144 disposed near a bottom of the gear mechanism 134 (opposite the connection portion 138). The gear teeth 144 are adapted to mate with corresponding second gear teeth 146 of a second gear portion 148 of the switch linkage arm 136 as described in further detail below.

The gear mechanism 134 also includes an aperture 150 adapted to allow a rear end of the motor 104 or a rear end of the motor shaft 122 to extend through or partially into the aperture 150. A bearing 152 (illustrated in FIG. 8) may be disposed in the aperture 150 and adapted to allow for rotation of the rear end of the motor shaft 122, during operation of the motor 104. The gear mechanism 134 may also include one or more cutouts 154/156. The one or more cutouts 154/156 are adapted to allow for wiring to extend from the motor 104 to the switch mechanism 106 and/or controller 124.

The gear mechanism 134 may also include one or more flanges 158/160 on opposing sides of the gear mechanism 134. The flanges 158/160 may be adapted to be disposed in corresponding internal surface features of the motor housing portion 116, and restrict axial movement of the gear mechanism 134 with respect to the motor housing portion 116.

The switch linkage arm 136 is adapted to be disposed in the housing 102 and interface with a switch 162 of the switch mechanism 106. The switch linkage arm 136 includes a second gear portion 148 with second gear teeth 146 disposed proximal to an end of the switch linkage arm 136. A stop 164 is disposed on an end opposite the second gear portion 148, and is adapted to engage the trigger 110 to prevent actuation of the direction selector 114 to change between the first rotational direction and second rotational direction when the trigger 110 is depressed.

The switch linkage arm 136 includes an aperture 166 between the stop 164 and second gear portion 148, that is adapted to receive the switch 162 of the switch mechanism 106. The switch linkage arm 136 includes also includes first and second protrusions 168/170 on opposing sides of the switch linkage arm 136.

Figure 7:
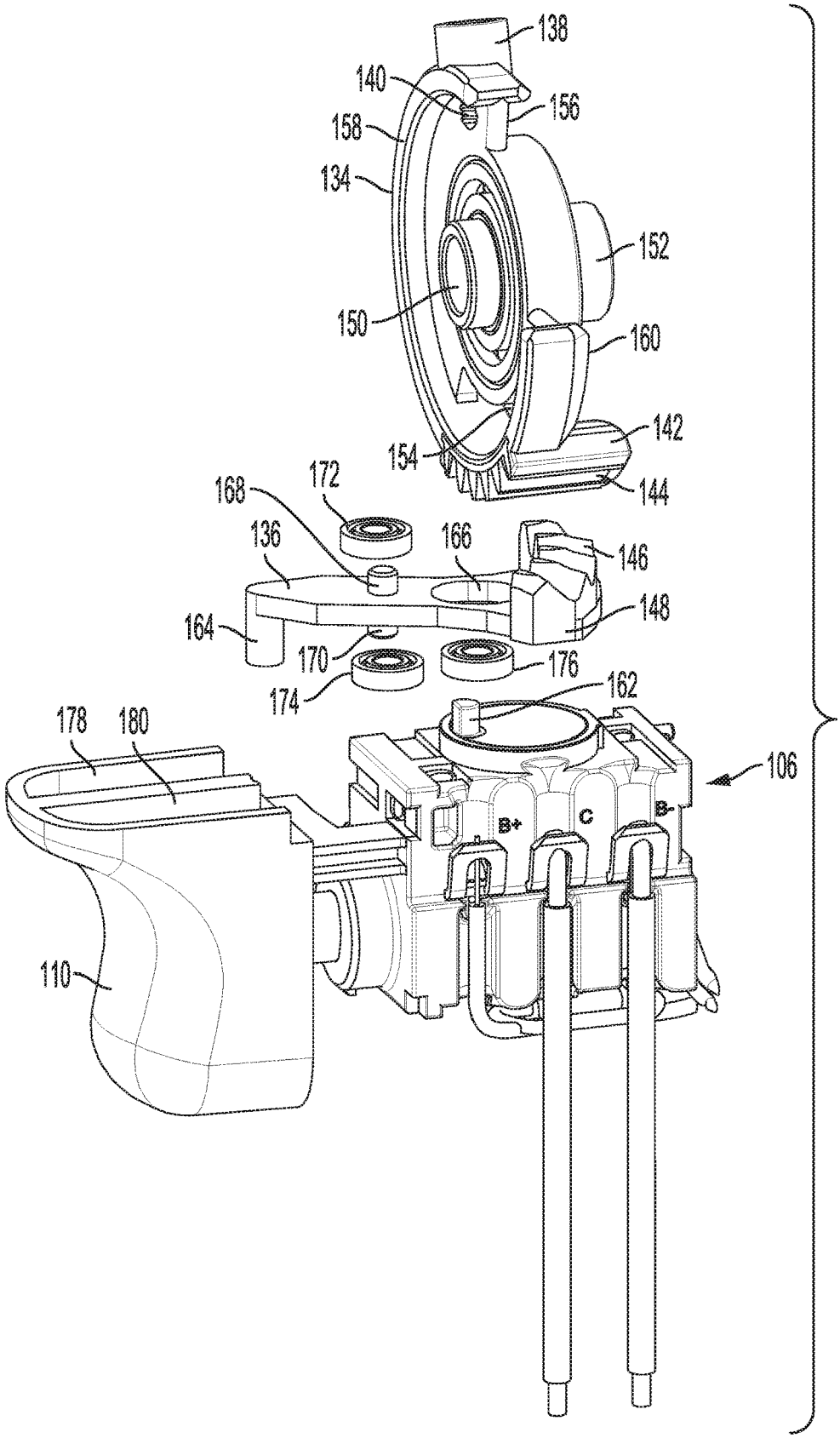
FIG. 7 is a perspective exploded view of the direction selector mechanism and switch mechanism of FIG. 6.

Referring to FIG. 7, first and second bearings 172/174 may be respectively disposed on the first and second protrusions 168/170. The first and second bearings 172/174 may also interface with the internal structure of the housing 102 to restrict undesired movement of the switch linkage arm 136 with respect to the housing 102. A third bearing 176 may be disposed in the aperture 166, and on the switch 162 of the switch mechanism 106.

Figure 6:
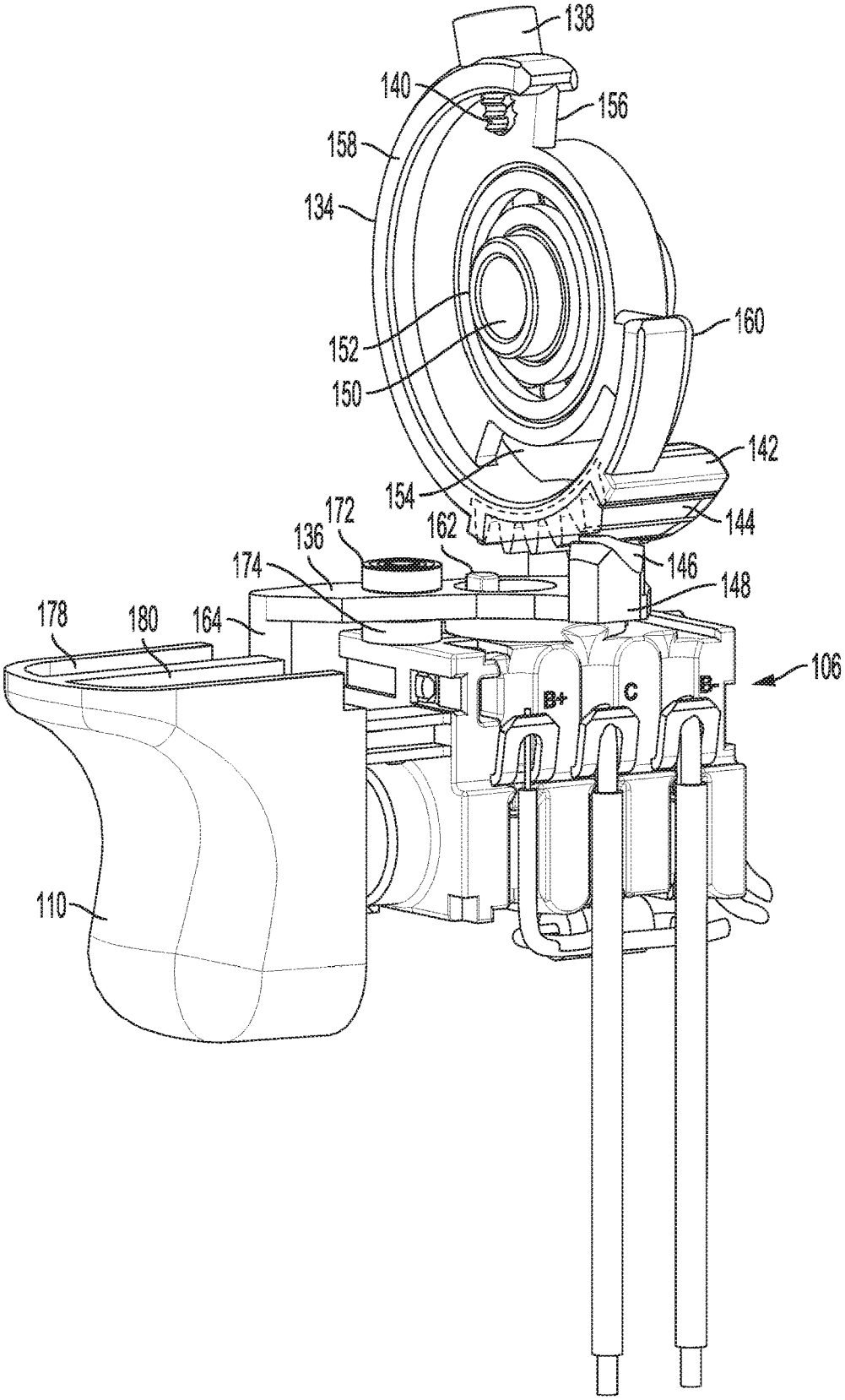
FIG. 6 is a perspective view of the direction selector mechanism and switch mechanism according to an embodiment of the present invention.
Figure 8:
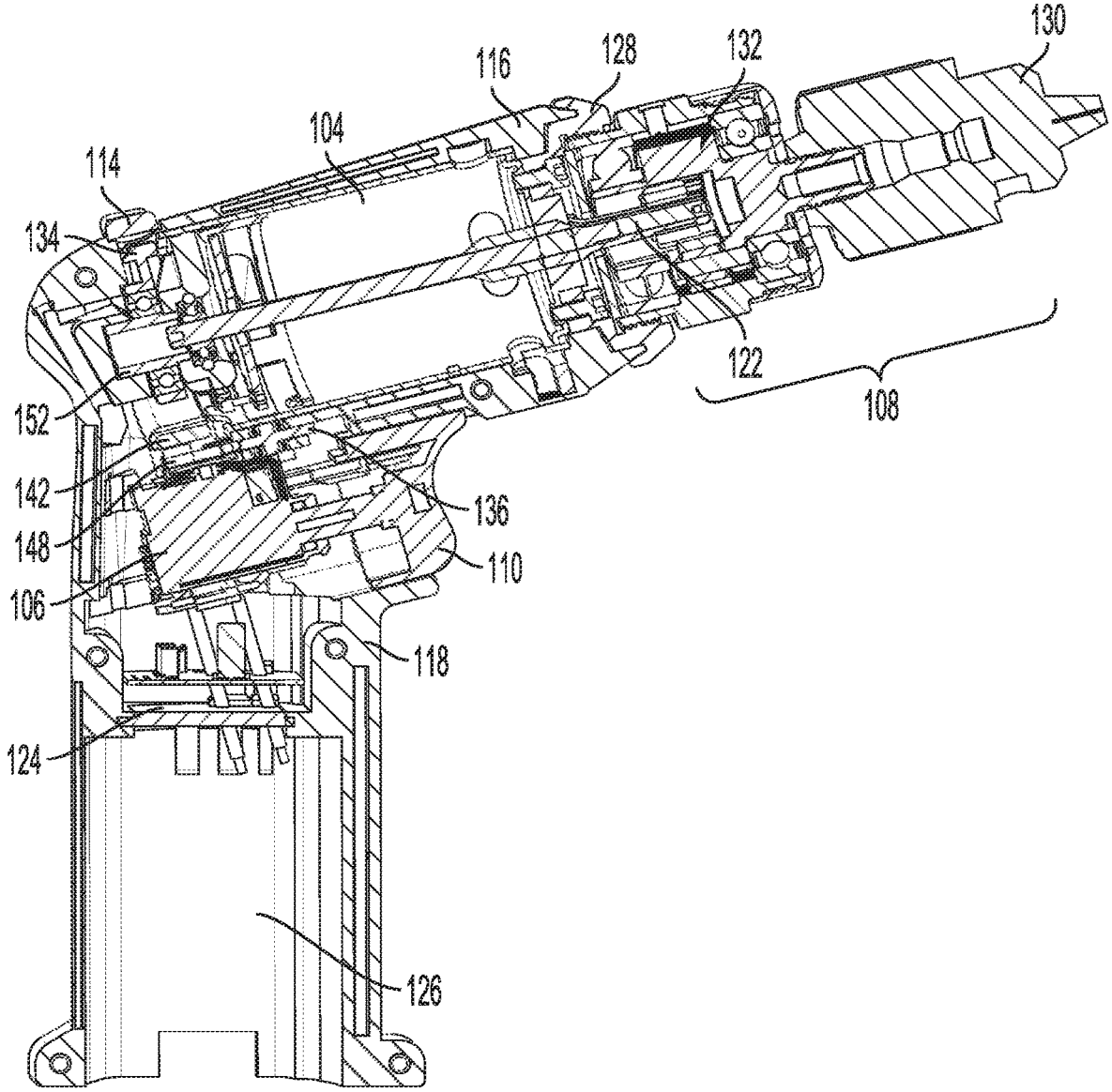
FIG. 8 is a cross-sectional view of the tool of FIG. 1 taken along a longitudinal axis of the tool according to an embodiment of the present invention.

Referring to FIGS. 6-8, the gear mechanism 134 is disposed in the housing 102 proximal to a rear of the motor 104, and bearing 152 disposed in the aperture 150. the rear end of the motor shaft 122 extends into the bearing 152, which allows the motor shaft 122 to rotate with respect to the gear mechanism 134 during operation of the motor. The direction selector 114 is coupled to the gear mechanism 134 at the connector 138, and is externally accessible from an exterior of the tool 100. The switch linkage arm 136 is disposed above the switch mechanism 106, with the second gear teeth 146 engage with the first gear teeth 144. The first and second bearings 172/174 are respectively disposed on the first and second protrusions 168/170 to allow the switch linkage arm 136 to rotate with respect to the housing 102. The third bearing 176 is disposed in the switch 162, and is positioned in the aperture 166 of the switch linkage arm 136.

During use, the direction selector 114 is moved in a left-to-right or right-to-left rotational fashion to select the desired rotation direction of the motor 104. For example, movement of the direction selector 114 to a first position causes the gear mechanism 134 to rotate, which causes the switch linkage arm 136 to rotate via the engagement of the first and second gear teeth 144 and 146. The movement of the switch linkage arm 136 causes the third bearing 176 to move, which causes the switch 162 to move to a corresponding first position, thereby selecting the first rotational direction of the motor 104. Thus, when the trigger 110 is depressed, the motor 104 rotates the motor shaft 122 in the first rotational direction.

When the direction selector 114 is in the first position, the stop 164 of the switch linkage arm 136 aligns with a first recess 178 in the trigger 110. When the trigger 110 is depressed, the stop 164 engages the first recess 178, and prevents actuation or movement of the direction selector 114. This prevents a user from purposefully or accidentally moving the direction selector 114 to a second position or switching from the first rotational direction to the second rotational direction while the trigger 110 is depressed.

To select the second rotational direction, the direction selector 114 is moved to a second position, which causes the gear mechanism 134 to rotate in an opposite direction, which again causes the switch linkage arm 136 to rotate via the engagement of the first and second gear teeth 144 and 146. The movement of the switch linkage arm 136 causes the third bearing 176 to move, which causes the switch 162 to move to a corresponding second position, thereby selecting the second rotational direction of the motor 104. Thus, when the trigger 110 is depressed, the motor 104 rotates the motor shaft 122 in the second rotational direction.

When the direction selector 114 is in the second position, the stop 164 of the switch linkage arm 136 aligns with a second recess 180 in the trigger 110. When the trigger 110 is depressed, the stop 164 engages the second recess 180 and prevents actuation or movement of the direction selector 114. This prevents a user from purposefully or accidentally moving the direction selector 114 to the second position or switching from the second rotational direction to the first rotational direction while the trigger 110 is depressed.

As best illustrated in FIGS. 1-3, the direction selector 114 is externally accessible from an exterior of the tool 100, and preferably positioned proximal to a rear of the tool 100. The direction selector 114 is movable by a user to select either of first and second rotational directions (e.g. clockwise and counter-clockwise). In an embodiment, the tool 100 may allow for about 30 to about 40 degrees of angular movement of the direction selector 114. The direction selector 114 may also have a "w" type shape. This position/location and shape of the direction selector 114 allows the user to select or change between the first and second rotational directions with a user's thumb for both direction changes, in either hand ambidextrously, and places the trigger 110 higher on the tool 100, closer to the axis of output of the tool 100. This provides ergonomic advantage during operation.

While the direction selector mechanism 112 is described above as including the direction selector 114, gear mechanism 134, and switch linkage arm 136, other linkage mechanism can be used, including a scotch yolk, one or more cables, and/or other linkage mechanisms that allow for the location of the direction selector to be placed away from the switch of the switch mechanism. Further, the direction selector mechanism may be adapted to position the location of the direction selector at any desired location on the tool.

Figure 9:
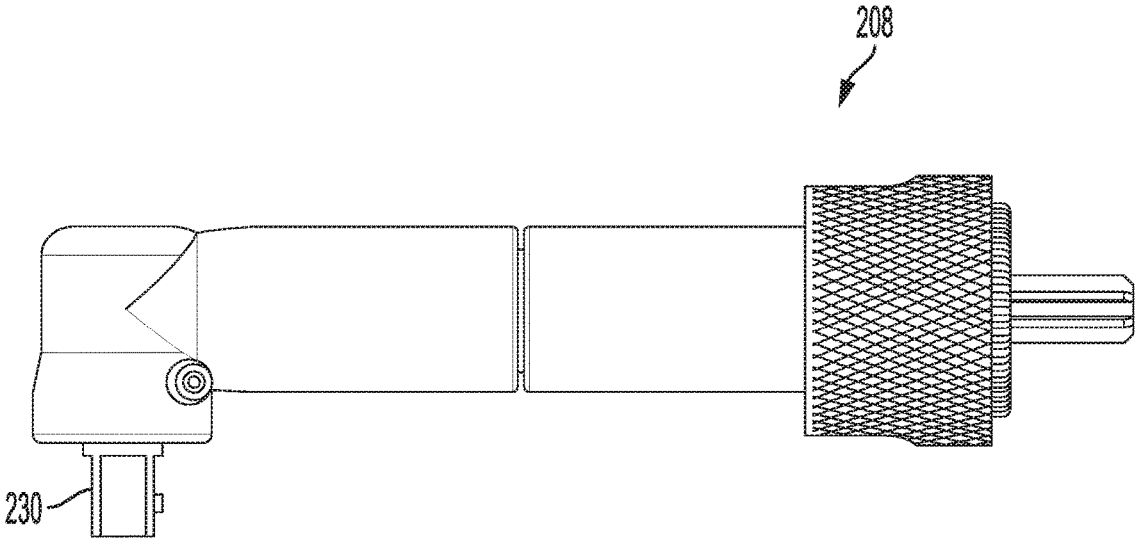
FIG. 9 is a side view of an exemplar router mechanism that can replace a drill and chuck mechanism of the tool according to an embodiment of the present invention.

While the tool 100 is described above as having an output nose mechanism 108 with a drill chuck 130, this is for exemplary purposes only, as the tool 100 may have one of many different types of output nose mechanisms. For example, and without limitation, referring to FIG. 9, in an embodiment, the tool 100 may include a output nose mechanism 208 that includes a router type output 230. In this example, the output nose mechanism 208 may be coupled to the adaptor 128 and may include a gear mechanism (similar to gear mechanism 132) that couples to the shaft 122 of the motor 104, and transfers rotation of the shaft 122 to the router type output 230. Thus, rotation of the shaft 122 of the motor 104 causes rotation of the router type output 230.

Figure 10:
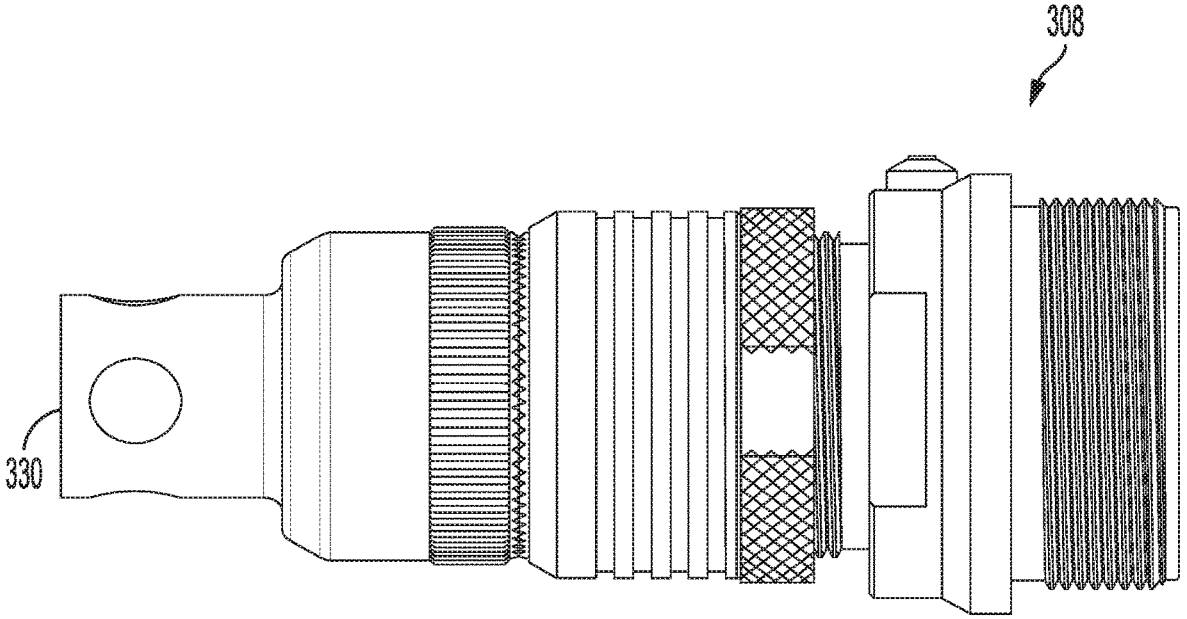
FIG. 10 is a side view of an exemplar impact mechanism that can replace the drill and chuck mechanism of the tool.

In another example, referring to FIG. 10, in an embodiment, the tool 100 may include a output nose mechanism 308 that includes an impact type output with a drive lug 330. In this example, the output nose mechanism 308 may be coupled to the adaptor 128 and may include a gear mechanism (similar to gear mechanism 132) that couples to the shaft 122 of the motor 104, and transfers rotation of the shaft 122 to the drive lug 330. Thus, rotation of the shaft 122 of the motor 104 causes rotation of the drive lug 330. The impact type output may deliver high torque output by storing energy in a rotating mass, then delivering it in impacting forces to the output shaft of the drive lug 330. The drive lug 330, can be coupled to other devices, such as a socket or other adapter, to apply torque to a work piece, such as, for example, a screw or bolt, in a well-known manner.

As discussed herein, the tool 100 is a drill, router, or impact wrench. However, the tool 100 can be any powered hand-held tool, including, without limitation, a drill, router, or impact wrench, ratchet wrench, screwdriver, or other powered tool, that is powered by electricity via an external power source (such as a wall outlet and/or generator outlet) or a battery.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object. As used herein, the term "a" or "one" may include one or more items unless specifically stated otherwise.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A tool including a housing, a motor disposed in the housing and adapted to selectively rotate a motor shaft in either of first and second rotational directions, and a switch mechanism disposed in the housing and operably coupled to the motor, the tool comprising:

a direction selector disposed on a top side of the tool;

a gear mechanism disposed in the housing proximal to a rear end of the motor and coupled to the direction selector, wherein the gear mechanism includes first gear teeth and movement of the direction selector causes the gear mechanism to rotate; and a switch linkage arm disposed in the housing and including second gear teeth engaged with the first gear teeth, wherein the switch linkage arm is engaged with a switch of the switch mechanism, and wherein rotation of the gear mechanism causes movement of the switch link arm, which causes movement of the switch to select either of the first and second rotational directions.

2. The tool of claim 1, wherein the gear mechanism includes an aperture adapted to receive a rear end of the motor shaft.

3. The tool of claim 1, wherein the direction selector is disposed near a rear end of the tool.

4. The tool of claim 1, wherein the gear mechanism includes a cut-out portion adapted to allow wiring to extend between the motor and the switch mechanism.

5. The tool of claim 1, wherein the switch linkage arm includes a stop disposed on an end opposite the second gear teeth, wherein the stop is adapted to engage a trigger of the tool to prevent actuation of the direction selector when the trigger is depressed.

6. The tool of claim 1, wherein the switch linkage arm includes first and second protrusions on opposing sides of the switch linkage arm.

7. The tool of claim 6, wherein the first and second protrusions are adapted to respectively engage first and second bearings disposed in the housing.

8. The tool of claim 1, wherein the switch linkage arm includes an aperture adapted to receive the switch.

9. The tool of claim 8, wherein the aperture is adapted to receive a bearing and the switch is adapted to be disposed in the bearing.

10. The tool of claim 1, wherein the direction selector has a substantially "w" shape and is adapted to allow a user to select or change between the first and second rotational directions with a user's thumb.

11. A direction selector mechanism for a motor of a tool, wherein the motor includes a motor shaft adapted to be selectively operated in either one of first and second rotational directions, the direction selector mechanism comprising:

a direction selector disposed on a top side of the tool and actuatable by a user;

a gear mechanism adapted to be disposed in a housing of the tool proximal to a rear end of the motor and coupled to the direction selector, wherein the gear mechanism includes first gear teeth and actuation of the direction selector causes the gear mechanism to rotate; and a switch linkage arm adapted to be disposed in the housing and including second gear teeth meshingly engageable with the first gear teeth, and the switch linkage arm is adapted to engage a switch of a switch mechanism disposed in the tool, wherein rotation of the gear mechanism causes movement of the switch link arm, which causes movement of the switch to select one of the first and second rotational directions.

12. The tool of claim 11, wherein the gear mechanism includes a cut-out portion adapted to allow wiring to extend between the motor and the switch mechanism.

13. The tool of claim 11, wherein the switch linkage arm includes a stop disposed on an end opposite the second gear teeth, wherein the stop is adapted to engage a trigger of the tool to prevent actuation of the direction selector when the trigger is depressed.

14. The tool of claim 11, wherein the switch linkage arm includes first and second protrusions on opposing sides of the switch linkage arm.

15. The tool of claim 14, wherein the first and second protrusions are adapted to respectively engage first and second bearings disposed in the housing.

16. The tool of claim 11, wherein the switch linkage arm includes an aperture adapted to receive the switch.

17. The tool of claim 16, wherein the aperture is adapted to receive a bearing and the switch is adapted to be disposed in the bearing.

18. The tool of claim 11, wherein the direction selector has a substantially "w" shape and is adapted to allow a user to select or change between the first and second rotational directions with a user's thumb.

19. The tool of claim 11, wherein the direction selector is disposed near a rear end of the tool.

* * * * *